United States Patent [19]

Smith, Jr. et al.

[11] 4,210,086

[45] Jul. 1, 1980

[54] COVER FOR SOAKING PITS AND THE LIKE

[75] Inventors: Homer Smith, Jr., Homewood, Ill.; Richard L. Pruitt, Valparaiso, Ind.; Edward F. Barnum, Gary, Ind.; Robert P. Knerr, Jr., Griffith, Ind.

[73] Assignee: Inland Steel Company, Chicago, Ill.

[21] Appl. No.: 904,795

[22] Filed: May 11, 1978

[51] Int. Cl.[2] ..... F23M 7/00

[52] U.S. Cl. ..... 110/173 A; 122/498; 432/250

[58] Field of Search ..... 122/498; 110/173 A; 432/250

[56] References Cited

U.S. PATENT DOCUMENTS

| | | | |
|---|---|---|---|
| 2,705,477 | 4/1955 | Braun | 110/173 |
| 3,198,178 | 8/1965 | Reighart | 110/173 |
| 3,588,062 | 6/1971 | Lloyd | 110/173 |
| 3,667,409 | 6/1972 | Motz et al. | 110/173 |
| 4,019,446 | 4/1977 | Abarotin et al. | 110/173 |

*Primary Examiner*—Edward G. Favors

*Attorney, Agent, or Firm*—Merriam, Marshall & Bicknell

[57] ABSTRACT

A novel and improved cover structure is provided for a furnace, particularly a soaking pit cover. The cover comprises a one-piece cast ferrous metal shell or body having a shallow recess at one side, a plurality of anchor devices secured in spaced relation to the base surface of the recess, and an insulating refractory lining disposed in and filling the recess and retained by the anchor devices. Preferably, the anchor devices are in the form of C-shaped metal hangers affixed to the base surface of the recess and refractory ribbed anchor blocks mounted in the hangers. The refractory lining is preferably a monolithic layer of rammable plastic or castable refractory, particularly a light weight refractory having a bulk density not greater than about 80 lb/ft$^3$ (1280 kg/m$^3$).

12 Claims, 5 Drawing Figures

COVER FOR SOAKING PITS AND THE LIKE

This invention relates to a novel and improved cover construction for furnaces, particularly soaking pits and the like.

Preparatory to metal processing operations such as rolling or forging, metal ingots or other metal objects are usually placed in appropriate furnaces for extended periods of time to bring the entire body of each ingot or object to the desired temperature. Annealing furnaces and soaking pits are examples of these types of furnaces. In the steel industry in particular, steel ingots are heated in soaking pits to a temperature on the order of 2150° to 2450° F. (1180° to 1340° C.) prior to hot working in a rolling mill. The soaking pits serve the dual function of heating and also acting as reservoirs to compensate for irregularities or interruptions in the flow of ingots between the steelmaking shop and the primary rolling mill.

Briefly, a soaking pit is a deep chamber or furnace into which the steel ingots are placed in upright position through a top opening. A removable cover or roof closes the pit opening, and the individual ingots are lowered into the pit and lifted out, as required, by means of a traveling crane and hoist.

The customary soaking pit cover in present day use consists of a heavy fabricated steel frame or grid which supports either a suspended arch of high-grade firebrick or a rammed plastic or castable refractory material held in position in the frame by refractory hangers. The steel frame of the cover usually has a peripheral depending skirt portion which supports the cover in a sand seal surrounding the top of the pit, and it is sometimes necessary to use special heat-resistant alloy castings for the skirt portion. The cover may be equipped with an individual cover carriage mechanism for lifting the cover vertically to free it from the sand seal and then shift the cover horizontally to open or close the pit opening. Alternatively, a cover crane may be provided which spans a row of pits and is shiftable to move the cover of any selected pit.

Because of the frequency of the opening and closing movements, soaking pit covers must be made especially strong and durable. However, the fabricated steel frame or grid of the conventional cover is formed from interconnected beams and structural elements, and even though extreme care is exercised in moving the cover, it is inevitable that a certain amount of deflection or flexing of the frame will occur during repeated handling. After a relatively short period of use, the brickwork or refractory becomes loose and separates from the frame in one or more localized areas. The repeated cooling and reheating of the brickwork or refractory at the underside of the cover also promotes spalling due to thermal shock with resultant loosening and disintegration. Such failures are particularly prevalent at the skirt portion of the cover, and as a consequence hot spots develop which eventually result in erosion and structural damage to the skirt. This in turn causes localized failure of the seal around the pit opening which allows hot gases and flames to escape and impinge against the unprotected exterior surfaces of the skirt portions of adjacent soaking pit covers, thereby accelerating failure of the adjacent covers and causing damage to the copings or curbs around the pit openings. Thus, the covers heretofore used have a relatively short useful life and must be removed from service frequently for expensive repairs to both the refractory and the frame.

A primary object of the present invention is to provide a novel and improved soaking pit cover which is highly resistant to deflection and flexing and which has a significantly longer useful life before repairs are necessary.

Other objects and advantages of the invention will be evident from the following detailed description in conjunction with the drawings, wherein.

Figures 1, 2, 3, 4, 5:
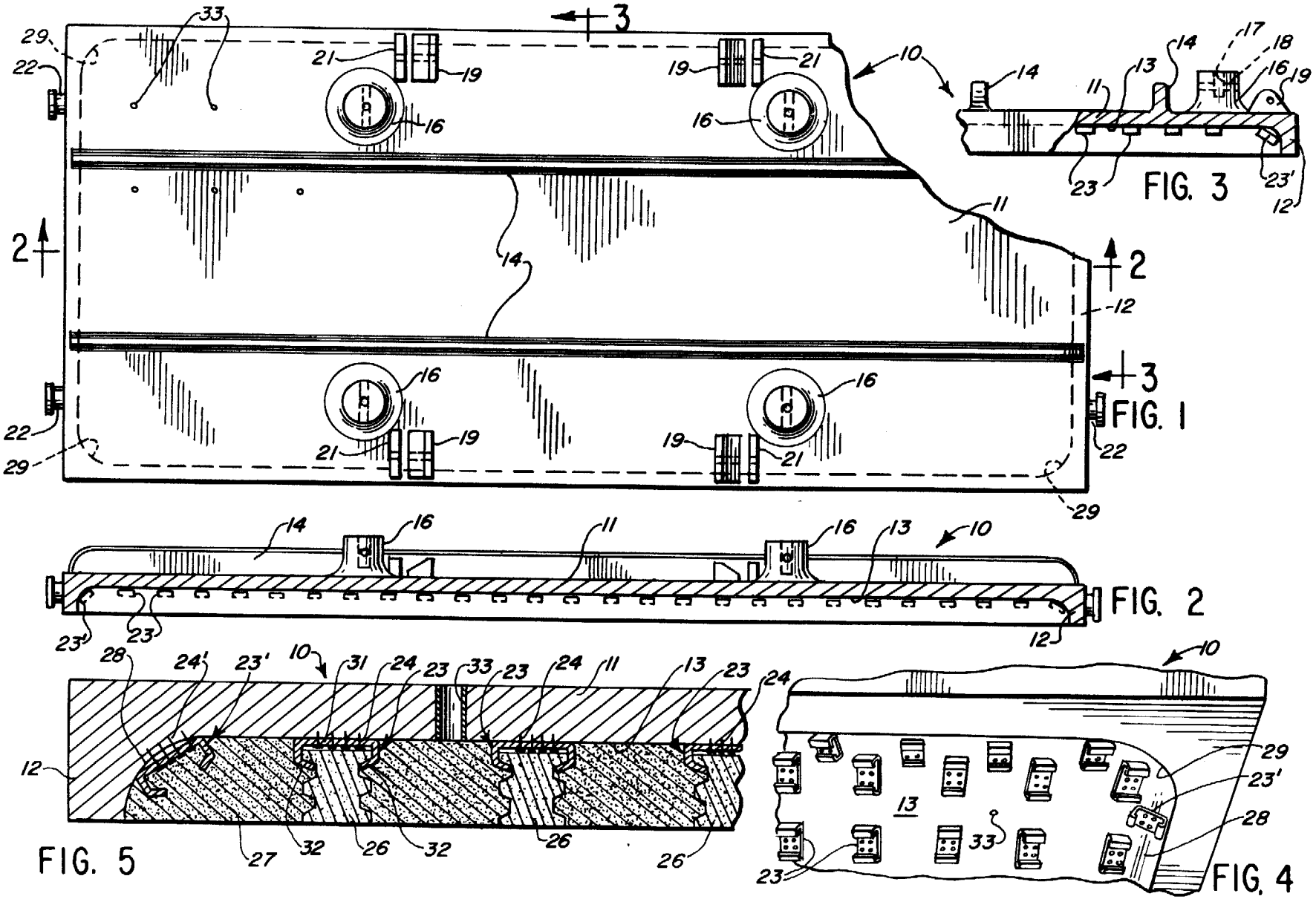
FIG. 1 is a top plan view of the shell or body of a soaking pit cover comprising a preferred embodiment of the invention.
FIG. 2 is a longitudinal sectional view taken along the line 2—2 of FIG. 1.
FIG. 3 is a fragmentary transverse sectional view as seen along the broken line 3—3 of FIG. 1.
FIG. 4 is a fragmentary perspective view of a corner portion of the shell or body.
FIG. 5 is an enlarged sectional view of a portion of the cover showing the refractory lining in place in the shell or body.

Briefly described, the improved cover of the present invention comprises a one-piece cast ferrous metal shell or body having a shallow recess at one side, a plurality of metal clips or hangers rigidly secured to the base surface of the recess, and refractory ribbed anchor bricks mounted in the clips or hangers. An insulating refractory lining substantially fills the recess in the shell or body and is preferably a monolithic layer of rammable plastic or castable refractory material deposited in the recess in embedding relation around the anchor bricks.

Referring first to FIGS. 1–4 of the drawing, the elongated rectangular shell or body portion is designated generally at 10 and has an inverted shallow box-like configuration with a flat plate portion 11 and a depending rim or skirt portion 12 extending continuously around the sides and ends of the shell to define a recess 13 at the underside of the shell. A pair of laterally spaced ribs 14 are formed integrally with the shell and extend lengthwise along the top surface of the plate portion 11 for strengthening and stiffening the structure. A plurality of bosses or lifting lugs 16 are also formed integrally at the top surface of the plate portion 11 and have vertical sockets 17 (FIG. 3) for receiving mating connecting elements (not shown) of a lifting crane which are removably pinned to the lugs 16 through cross bores 18 (FIG. 3). Other apertured handling lugs or brackets 19 and 21 are also integrally formed at the top surface of the plate portion 11 adjacent the bosses 16. The end walls of the skirt portion 12 are provided with integral trunuions 22 for handling purposes at the foundry.

In accordance with the invention, the entire shell structure 10 is formed as a massive one-piece casting of ferrous metal, preferably cast iron, using conventional foundry practices. Although nodular iron, gray iron or alloyed iron may be used, it is a particular advantage of the invention that ordinary pig iron or molten iron direct from the blast furance has been found to be well suited for this purpose. Whereas the conventional prior art soaking pit cover has a fabricated steel frame of interconnected cross members and is therefore subject to objectionable distortion and flexing during movement of the cover, as heretofore described, the integral cast shell or body 10 of the present invention has a one-piece construction of exceptional rigidity and resistance to deflection during normal handling operations.

A plurality of generally C-shaped metal clips or hangers 23 are rigidly affixed in spaced relation to the underside of the plate portion 11 which comprises the base surface of the recess 13. Each clip has a flat base portion 31 and opposed gripping portions or flanges 32 (FIG. 5). Preferably, the clips 23 are of stainless steel or other corrosion resistant and heat resistant alloy steel. The clips 23 may be secured to the shell 10 by any suitable means, but we have found that the cast iron material of the shell permits the use of explosive driven nails or fasteners, as designated schematically at 24 in FIG. 5. The nails 24 extend through the clip base portions 31 into the shell 10. Since a large number of clips are used, this is a particularly desirable means of mounting the clips because it is fast and relatively inexpensive compared to other fastening systems. Conventional ribbed anchor bricks 26 are inserted between the gripping portions 32 of the clips 23 and extend downwardly for substantially the entire depth of the recess 13 (FIG. 5) so that the lower end surfaces of the bricks are in substantially flush alignment with the flat lower end surface of the skirt 12 at the edge of the recess 13.

Although various types of refractory can be used in the cover, the recess 13 is preferably substantially filled with a monolithic refractory lining 27 (FIG. 5) which surrounds and embeds the clips 23 and the anchor bricks 26. Any industrial refractory material suitable for forming monolithic linings may be used such as plastic refractories, ramming materials, castables, gunning mixes, and granular materials. Rammable plastic and castable refractories are preferred for convenience and effectiveness. However, it is a particular advantage of the present invention that the rigid and highly deflection resistant cast shell or body 10 makes it feasible to use a relatively light weight refractory. For example, light weight castable refractories are characterized by superior insulating properties since the thermal conductivity is on the order of two-thirds of the thermal conductivity of conventional heavy weight castables. However, the light weight castable refractories also have a lower modulus of rupture than the heavy weight castables, and this lower strength has heretofore deterred the use of light weight castables in conventional soaking pit covers which are subject to repeated distortion and deflecting forces during normal handling.

Light weight refractories, particularly light weight castables, as used in the present invention generally have a bulk density of not more than about 80 lb/ft$^3$ (1280 kg/m$^3$). For steel industry application, i.e. covers for steel ingot soaking pits, the refractory should be one suitable for service at 3000° F. (1650° C.) with a bulk density of about 75 to 80 lb/ft$^3$ (1200 to 1280 kg/m$^3$). However, for other types of metal furnaces operating at lower temperatures, e.g. an aluminum ingot soaking pit, light weight castables having a bulk density as low as about 20 lb/ft$^3$ (320 kg/m$^3$) may be used.

Experience has shown that failure of a monolithic refractory layer is more likely to occur in the shoulder or connecting juncture between the plate portion 11 and the skirt portion 12 of the shell 10. To improve the structural integrity of the refractory layer 27 in these regions, the shoulder area extending entirely around the recess 13 is formed as a curve having a relatively large radius in a vertical plane, as shown at 28 in FIGS. 4 and 5, thereby avoiding abrupt angular corners or pockets. Likewise the four corners of the casting in a horizontal plane are also curved on a large radius, as designated at 29 in FIGS. 1 and 4. In addition, a plurality of C-shaped clips 23' are mounted using nails 24' in a single peripheral row on the curved surface 28. In this instance no anchor bricks are provided, and the clips 23' are embedded in the refractory lining 27 for strengthening the latter in the curved shoulder region.

The cover construction illustrated in the drawing is assembled in the following manner. The cast shell or body portion 10 is supported horizontally with the recess 13 facing upwardly, and the clips 23 and 23' are installed. The anchor bricks 26 are then mounted in the clips 23, and wedges or shims (not shown) are inserted between the base portions of the clips and the inner end surfaces of the anchor bricks so that the bricks are seated against the clip flanges and the outer end surfaces of the bricks are in substantially flush alignment with the flat face of the skirt portion 12. The monolithic refractory lining 27 is preferably formed by pouring a light weight castable refractory composition into the recess 13 and distributing it uniformly until the recess 13 is filled to its entire depth. A conventional vibrator may be applied to the castable mixture to assist in settling and distribution in the recess 13. In cases where a heavier refractory lining is used, e.g. a rammable plastic refractory, the cast iron shell or body 10 may be vibrated to facilitate settling and distribution of the refractory composition in the recess 13.

After the refractory composition has hardened or set at ambient conditions, the cover is then inverted and placed over a furnace pit for high temperature drying and curing. During the latter step water vapor is expelled from the inner surface of the refractory layer 27 through a plurality of small diameter weep holes 33 extending through the thickness of the plate portion 11. Although only a few weep holes 33 are illustrated in FIG. 1, it should be understood that the weep holes are distributed over the entire area of the plate portion 11. As seen in FIG. 5, the final dried and cured refractory layer 27 is firmly secured in the recess 13 by mechanical interlock with the ribbed anchor bricks 26 and also with the clips 23' in the curved shoulder region 28 which are in embedded relation in the refractory layer.

As a specific example of the invention, a cover for a steel ingot soaking pit was constructed having the configuration shown in the drawing. The body or shell 10 was a one-piece casting of blast furnace iron. The outer dimensions of the shell 10 were 130×292 in. (3.3×7.4 m); the depth of the cavity 13 was 6¼ in. (159 mm); the wall thickness of both the plate portion 11 and the skirt portion 12 was 4 in. (102 mm); the radius of the curved shoulder 28 was 6¼ in. (159 mm); and the radius of the curved corners 29 was 12 in. (305 mm). The height of the reinforcing ribs 14 was 8 in. (203 mm) and the thickness of the ribs was approximately 3 in. (76 mm). The plate portion 11 contained 2 in. (51 mm) diameter weep holes 29 distributed uniformly over the entire area on about 24 in. (610 mm) centers.

Approximately 280 stainless steel (#304) C-clamp brick hangers 23 were installed on 12 in. (305 mm) centers on the base surface of the cavity 13 using four special alloy nails per hanger which were driven by a Hilti DX powder-actuated fastener driving tool, and approximately 72 such hangers 23' were installed in the same manner in a single row around the curved shoulder surface 28. Ribbed anchor bricks 26 were mounted in the hangers 23, and the anchor bricks were then painted to prevent absorption of moisture during pouring of the refractory. Shims or wedges were inserted between the base portions of the hangers and the end surfaces of the anchor bricks to seat the anchor bricks against the retaining portions of the hangers.

A refractory composition was prepared from a low density castable identified as RESCO LITE WEIGHT castable and obtained from North State Pyrophyllite Inc. of Greensboro, North Carolina. The dry castable was mixed with water in suitable proportions, and the resultant mixture was poured into the cavity 13 and distributed uniformly with the assistance of vibration applied to the refractory. After air-curing for about 24 hours the refractory lining was heat cured by placing the cover over a fired soaking pit. The bulk density of the fired lining was about 80 lb/ft$^3$ (1280 kg/m$^3$). Alternative low density castable refractories which can be used, by way of example, are CER-LITE 75 obtainable from C-E Refractories, a division of Combustion Engineering, Inc. of Valley Forge, Pennsylvania, and LITE-CAST 75-28 obtainable from General Refractory Co. of Sproul, Pennsylvania and Troup, Texas, each having a fired bulk density of about 75 lb/ft$^3$ (1200 kg/m$^3$).

In summary, the cover of the present invention using a one-piece cast shell or body has the following advantages over the conventional cover which uses a fabricated steel frame:

(1) The massive one-piece cast shell or body is extremely rigid and resistant to deflection during repeated handling so as to minimize or eliminate mechanical damage to the refractory lining.

(2) The rigidity and deflection resistance of the shell or body makes it feasible to use a light weight castable refractory lining which has a lower thermal conductivity and superior insulating properties compared to the higher density castables normally used for such service.

(3) A smaller amount of the light weight castable is required, e.g. a 6 in. (152 mm) thick lining, as compared with a lining of about 9 in. (229 mm) thickness required for a higher density castable.

(4) The improvement in refractory life results in substantially reduced costs for repair of damaged covers, e.g. at least ⅓ less in terms of materials and labor.

(5) Hot spot problems are greatly minimized because even when minor refractory failure occurs the massive cast iron shell acts as a heat sink and rapidly dissipates any heat which reaches the shell through the damaged area of the refractory.

(6) Because of the greatly improved refractory life and the avoidance of skirt damage encountered with a conventional cover, very little repair or maintenance work is required on the copings or curbs of the soaking pits. In addition, since the refractory lining of the cover is substantially flush or even with the cast body, the flat surface provides for better weight distribution on the coping as compared with the "knife edge" seal provided by the projecting skirt of a conventional cover.

(7) The sustained effectiveness of the seal at the soaking pit opening is dramatically improved as compared with the use of conventional covers.

(8) Excellent and uniform heat curing of the refractory lining is realized because there is minimal exposure of the cast refractory to the atmosphere through the weep holes at the interface between the lining and the shell, whereas in a conventional cover the fabricated steel framework has large open areas resulting in incomplete curing of the lining at the cold surface.

(9) The massive cast iron shell or body lends itself readily to the use of vibrating forces imposed on the shell to assist in uniform settling and distribution of a rammable plastic refractory.

Although the invention has been described with particular reference to the illustrated specific embodiment, it will be understood that various modifications may be used without departing from the scope of the invention as defined in the appended claims.

We claim:

1. A cover construction for a furnace, such as a soaking pit or the like, which is subject to repeated stress during handling, said cover construction comprising:

an integral one-piece cast body of ferrous metal, said body having a plate portion and a peripheral depending skirt portion defining an enlarged recess at one side of said body;

anchor means comprising a plurality of anchor devices secured in spaced relation to the surface of said plate portion at the base of said recess; and a monolithic insulating refractory lining disposed in and substantially filling said recess and mechanically interlocked with said anchor means, said lining comprising a monolithic layer of light weight refractory having a bulk density not greater than about 80 lb/ft$^3$ (1280 kg/m$^3$).

2. The cover construction of claim 1 wherein said refractory is a light weight castable refractory suitable for service at about 3000° F. (1650° C.) with a bulk density of about 75 to 80 lb/ft$^3$ (1200 to 1280 kg/m$^3$).

3. The cover construction of claims 1 or 2 wherein said body is blast furnace iron.

4. A cover construction for a furnace, such as a soaking pit or the like, which is subject to repeated stress during handling, said cover construction comprising:

an integral one-piece cast body of ferrous metal, said body having a plate portion and a peripheral depending skirt portion defining an enlarged recess at one side of said body;

anchor means comprising a plurality of anchor devices secured in spaced relation to the surface of said plate portion at the base of said recess; and a monolithic insulating refractory lining disposed in and substantially filling said recess and mechanically interlocked with said anchor means;

said anchor devices comprising generally C-shaped metal hanger elements each having a base portion and opposed gripping portions, the base portions of said hanger elements being secured to said body by fastening elements extending though said base portions into said body, and refractory ribbed anchor bricks mounted in and retained by said gripping portions, said bricks extending substantially to the outer edge of said recess in embedded relation in said refractory lining.

5. A cover construction for a furnace, such as a soaking pit or the like, which is subject to repeated stress during handling, said cover construction comprising;

an integral one-piece cast body of ferrous metal, said body having a plate portion and a peripheral depending skirt portion defining an enlarged recess at one side of said body, the continuous juncture between said plate portion and said skirt portion within said recess having a curved surface on a substantial radius in a vertical plane;

anchor means comprising a plurality of anchor devices secured in spaced relation to the surface of said plate portion at the base of said recess; and a monolithic insulating refractory lining disposed in and substantially filling said recess and mechanically interlocked with said anchor means.

6. The cover construction of claim 5 wherein additional anchor devices are affixed in spaced relation around said curved surface of said juncture.

7. The cover construction of claim 6 wherein said additional anchor devices comprise a plurality of generally C-shaped metal hanger elements in embedded relation in said refractory lining.

8. A cover construction for a furnace, such as a soaking pit or the like, which is subject to repeated stress during handling, said cover construction comprising:

an integral one-piece cast body of ferrous metal, said body having a plate portion and a peripheral depending skirt portion defining an enlarged recess at one side of said body, the outer surface of said plate portion opposite said recess being provided with elongated integral strengthening ribs;

anchor means comprising a plurality of anchor devices secured in spaced relation to the surface of said plate portion at the base of said recess, and a monolithic insulating refractory lining disposed in and substantially filling said recess and mechanically interlocked with said anchor means.

9. A cover construction for a furnace, such as a soaking pit or the like, which is subject to repeated stress during handling, said cover construction comprising:

an integral one-piece cast body of ferrous metal, said body having a plate portion and a peripheral depending skirt portion defining an enlarged recess at one side of said body, said plate portion being provided with a plurality of weep holes;

anchor means comprising a plurality of anchor devices secured in spaced relation to the surface of said plate portion at the base of said recess; and a monolithic insulating refractory lining disposed in and substantially filling said recess and mechanically interlocked with said anchor means, said weep holes permitting escape of moisture during drying and curing of said refractory lining.

10. A cover construction for a soaking pit for steel ingots, comprising:

an integral one-piece cast iron body having a plate portion and a depending peripheral skirt portion defining an enlarged recess at one side of said body, the continuous juncture between said plate portion and said skirt portion within said recess having a curved surface on a substantial radius in a vertical plane;

anchor means comprising a plurality of metal hanger elements secured in spaced relation to the surface of said plate portion at the base of said recess, and refractory anchor bricks mounted on said hanger elements and extending substantially to the outer edge of said recess;

additional anchor means comprising a plurality of additional metal hanger elements secured in spaced relation around said curved surface of said juncture; and a monolithic insulating refractory lining disposed in and substantially filling said recess and mechanically interlocked in embedding relation with said anchor means and said additional anchor means.

11. The cover construction of claim 10 wherein said lining is formed from a light weight castable refractory suitable for service at about 3000° F. (1650° C.) and having a bulk density of about 75 to 80 lb/ft$^3$ (1200 to 1280 kg/m$^3$).

12. The cover construction of claim 10 wherein said lining is formed from a rammable plastic refractory.

* * * * *